US010914165B2

(12) United States Patent
Pelletier et al.

(10) Patent No.: US 10,914,165 B2
(45) Date of Patent: Feb. 9, 2021

(54) METHODS AND SYSTEMS FOR DOWNHOLE TELEMETRY EMPLOYING CHEMICAL TRACERS IN A FLOW STREAM

(71) Applicant: Halliburton Energy Services, Inc., Houston, TX (US)

(72) Inventors: Michael T. Pelletier, Houston, TX (US); Li Gao, Katy, TX (US); Christopher M. Jones, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 16/316,265

(22) PCT Filed: Sep. 22, 2016

(86) PCT No.: PCT/US2016/053150
§ 371 (c)(1),
(2) Date: Jan. 8, 2019

(87) PCT Pub. No.: WO2018/056990
PCT Pub. Date: Mar. 29, 2018

(65) Prior Publication Data

US 2020/0256184 A1 Aug. 13, 2020

(51) Int. Cl.
*E21B 47/11* (2012.01)
*E21B 34/06* (2006.01)
*E21B 47/18* (2012.01)

(52) U.S. Cl.
CPC ..... *E21B 47/11* (2020.05); *E21B 34/06* (2013.01); *E21B 47/18* (2013.01)

(58) Field of Classification Search
CPC ..... E21B 47/12; E21B 47/11; E21B 47/017; E21B 47/26; E21B 41/00; E21B 47/18; E21B 47/01
See application file for complete search history.

(56) References Cited

U.S. PATENT DOCUMENTS 7,560,690 B2 7/2009 Stray et al.
8,603,827 B2 12/2013 Zahlsen et al.
8,949,029 B2 2/2015 Nyhavn
(Continued)

FOREIGN PATENT DOCUMENTS

WO 2018056990 A1 3/2018

OTHER PUBLICATIONS

Nyhavn, F., et al., "Permanent Tracers Embedded in Downhole Polymers Prove Their Monitoring Capabilities in a Hot Offshore Well," SPE 135070, 15 Pages, Sep. 19-22, 2010, SPE Annual Technical Conference and Exhibition.
(Continued)

*Primary Examiner* — Zakiya W Bates
(74) *Attorney, Agent, or Firm* — Thomas Rooney; Parker Justiss, P.C.

(57) ABSTRACT

A method includes collecting tracer concentration measurements from a flow stream in a borehole as a function of time. The method also includes recovering an uplink telemetry signal from the collected tracer concentration measurements, wherein the uplink telemetry signal conveys a downhole tool measurement or communication. The method also includes performing an operation in response to the recovered uplink telemetry signal.

21 Claims, 11 Drawing Sheets

(56) References Cited

U.S. PATENT DOCUMENTS

| | | | | |
|---|---|---|---|---|
| 2004/0204856 | A1 | 10/2004 | Jenkins et al. | |
| 2007/0188344 | A1 | 8/2007 | Hache et al. | |
| 2011/0069583 | A1 | 3/2011 | Camwell et al. | |
| 2011/0277544 | A1 | 11/2011 | Rytlewski et al. | |
| 2012/0118564 | A1* | 5/2012 | Gomes ..... | E21B 43/08 166/250.12 |
| 2015/0134253 | A1 | 5/2015 | Ring et al. | |

OTHER PUBLICATIONS

Kuck, M.D., et al., "Production Monitoring by Intelligent Chemical Inflow Tracers in Long Horizontal Heavy Oil Wells for the Nikaitchuq Field, Northern Alaska," IPTC 17458, 10 pages, Jan. 20-22, 2014, International Petroleum Technology Conference.

Mjaaland, S., et al., "Wireless Inflow Monitoring in a Subsea Field Development: A Case Study From the Hyme Field, Offshore Mid-Norway," SPE-170619-MS, SPE Annual Technical Conference and Exhibition, Oct. 27-29, 2014, 13 pages.

* cited by examiner

METHODS AND SYSTEMS FOR DOWNHOLE TELEMETRY EMPLOYING CHEMICAL TRACERS IN A FLOW STREAM

CROSS-REFERENCE TO RELATED APPLICATION

This application is the National Stage of, and therefore claims the benefit of, International Application No. PCT/US2016/053150 filed on Sep. 22, 2016, entitled "METHODS AND SYSTEMS FOR DOWNHOLE TELEMETRY EMPLOYING CHEMICAL TRACERS IN A FLOW STREAM," which was published in English under International Publication Number WO 2018/056990 on Mar. 29, 2018. The above application is commonly assigned with this National Stage application and is incorporated herein by reference in its entirety.

BACKGROUND

As part of hydrocarbon exploration or production operations, boreholes are drilled into the earth. The boreholes may be used for logging operations that determine downhole formation properties and/or the borehole may be completed by installing and cementing a casing string in the borehole. With the installed casing string, the flow of fluid to a downhole formation (injection operations) or from downhole formation (production operations) can be controlled.

Many downhole operations involve or can be improved by telemetry operations between different downhole components and/or between a downhole component and a component at earth's surface. When a continuous electrical conductor is available, telemetry based on conveyance of modulated electrical signals is a good option. However, a continuous electrical conductor is often not available in a downhole environment. There are some telemetry options that do not need a continuous electrical conductor. For example, wireless electromagnetic (EM) telemetry, acoustic telemetry, and pressure pulse telemetry have been considered for downhole use. Efforts to provide specialty telemetry options suitable for communications in a downhole environment are ongoing.

BRIEF DESCRIPTION OF THE DRAWINGS

Accordingly, there are disclosed in the drawings and the following description methods and system for downhole telemetry employing chemical tracers in a flow stream.

Figure 1:
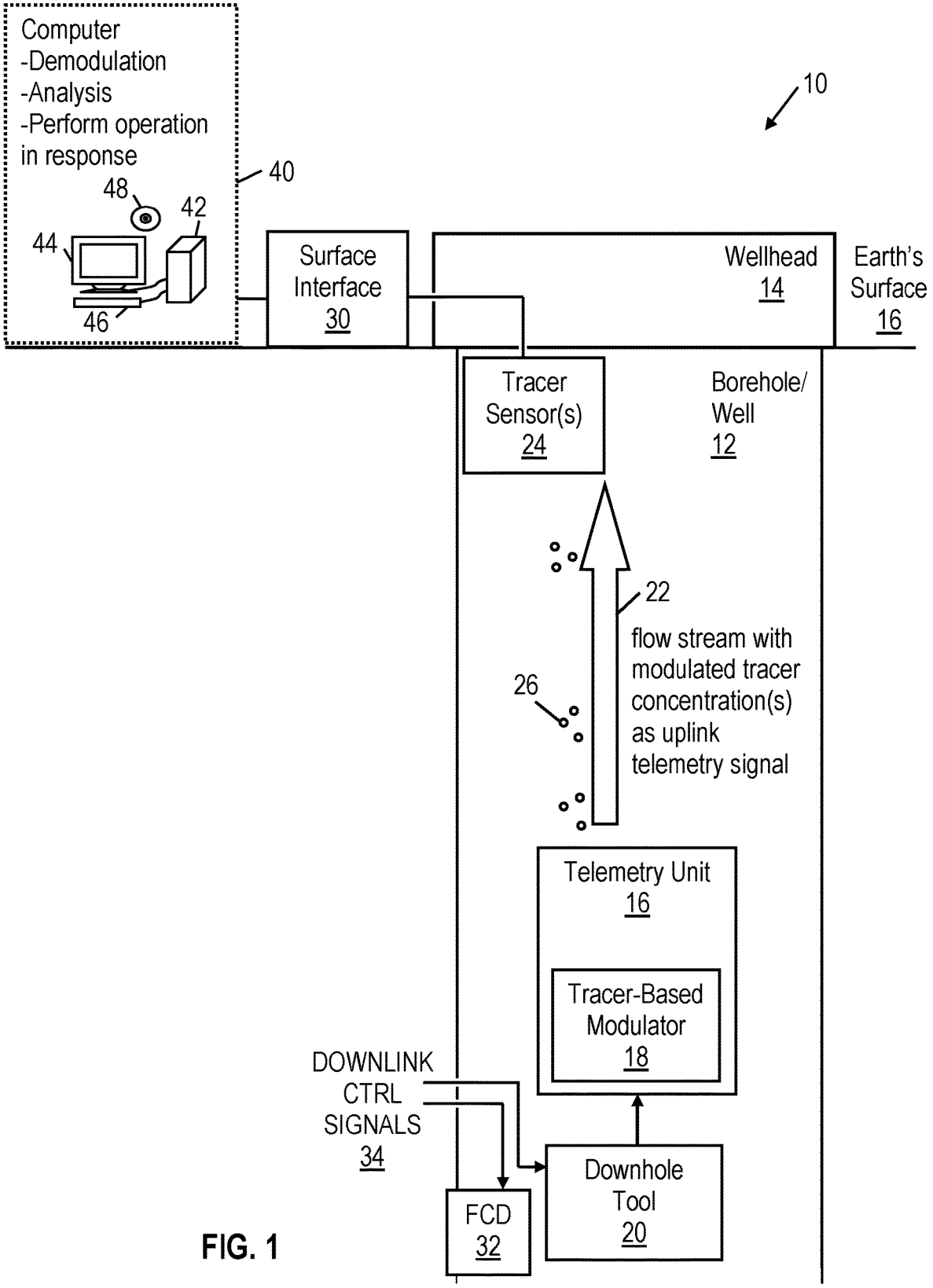
FIG. 1 is a block diagram showing an illustrative system employing chemical tracers in a flow stream.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are methods and systems for downhole telemetry employing chemical tracers in a flow stream. As used herein, "chemical tracers" (sometimes referred to herein as just "tracers") refer to a set of one or more chemical species that are detectable from a flow stream. While merely the existence of a tracer in a flow stream can provide information, the techniques described herein involve detecting a concentration level of one or more tracers in a flow stream. Different tracers may be selected for conveyance by a water-phase fluid, an oil-phase fluid, or a gas. Suitable tracers include, for example, water-phase alcohols, esters, and fluorescein group molecules. Other suitable tracers include, for example, oil phase $\alpha$-olefins (with double bond not found in naturally occurring oils reservoir fluids), quinones, halogenated hydro carbons (gas phase acetylene). Other tracers are possible as well so long as the tracers can be detected and distinguished from other chemical species present in the flow stream. To detect the concentration of each tracer, tracer sensors can be deployed in a borehole or along a flow path for produced fluid (i.e., fluid conduits at or near earth's surface). Example tracer sensors may employ spectroscopy techniques (with or without a sample chamber) to detect a tracer concentration. The characteristics of light conveyed by an optical fiber can be modulated in accordance with a tracer sensor that is integrated with the optical fiber or coupled to the optical fiber. Alternatively, fluid samples can be periodically collected from a flow stream. The collected samples can be analyzed in a laboratory at earth's surface to determine the tracer concentrations. Alternatively, for water-phase tracer conveyance, a salt-based tracer can be detected by analysis of a conductivity or specific ion shift. Alternatively, for oil-phase tracer conveyance, another detection option involves oil phase toggling of a viscosity tracer, where a measured fluid flow parameter (e.g., pressure) as fluid passes through a flow control point (e.g., a choke) conveys tracer concentration information. To ensure demodulation of a telemetry signal is possible, the collection of samples and/or the tracer concentration measurements can be synchronized with a known or monitored clock rate related to the modulation scheme.

As an example, an uplink telemetry signal can be recovered from tracer concentration measurements collected as a function of time, where the uplink telemetry signal conveys a downhole tool measurement or communication. The uplink telemetry signal is provided, for example, by a telemetry unit that is part of the downhole tool or that is in communication with the downhole tool. Regardless of whether the telemetry unit is part of the downhole tool or not, the telemetry unit receives a downhole tool measurement or communication, and then operates to provide a tracer-based uplink telemetry signal. Various telemetry unit options are disclosed herein to accomplish the task of providing a tracer-based uplink telemetry signal (i.e., the concentration of one or more tracers in a flow stream as a function of time corresponds to an uplink telemetry signal that conveys the downhole tool measurement or communication).

In some embodiments, the downhole tool corresponds to an individual sensor (e.g., a temperature sensor, a pressure sensor, a flow rate sensor, an actuation sensor, or other sensors) deployed in a borehole temporarily or permanently. In other embodiments, the downhole tool corresponds to a logging tool (e.g., a resistivity logging tool, an acoustic logging tool, a seismic logging tool, a nuclear magnet resonance logging tool, or other logging tools) deployed in a borehole temporarily or permanently. To temporarily deploy the downhole tool a wireline, slickline, or coiled tubing may be used. Meanwhile, permanent deployment options for the downhole tool may involve attaching the downhole tool to or integrating the downhole tool with a casing string that is installed in a borehole. In at least some embodiments, the downhole tool and/or the downhole telemetry unit is retrofitted into an existing well. Such retrofitting can be accomplished, for example, using retrofit devices such as side pocket mandrels, swellable packers, controllable anchors or chucks. Mechanical retrofitting options, magnetic retrofitting options, or a combination thereof are possible. Once the downhole tool and/or the downhole telemetry unit has reached a target position, a related retrofit device may operate to keep the downhole tool and/or the downhole telemetry unit in place along a casing string or production tubing. In at least some embodiments, retrofit devices, the downhole tool and/or the downhole telemetry unit can be configured and deployed downhole to enable ongoing production operations (i.e., fluid flow in a well is still possible after retrofit devices, the downhole tool and/or the downhole telemetry unit are deployed).

Once the uplink telemetry signal is recovered from tracer concentration measurements collected as a function of time, one or more operations can be performed in response to the recovered uplink telemetry signal. For example, a computer may display individual measurements or a log of measurements collected by the downhole tool. Also, a computer may display a communication (i.e., a tool status or health message) or alert. In at least some embodiments, a computer provides a user interface that enables an operator to select downhole communications or operations in response to the uplink telemetry signal. For example, an operator may send a new downlink command to the downhole tool in response to the uplink telemetry signal. Additionally or alternatively, an operator may send a new downlink command to another downhole component deployed in the borehole. For example, flow control devices (FDCs) may be adjusted in response to the uplink telemetry signal. While an operator may be involved when interpreting the uplink telemetry signal and/or when selecting a response, it is also possible to automate interpretation of the uplink telemetry signal and/or to automate a response. A computer with preprogramming or software can automate the process of handling the uplink telemetry signal and selecting an appropriate response.

In at least some embodiments, an example method includes collecting tracer concentration measurements from a flow stream in or from a borehole as a function of time. The example method also includes recovering an uplink telemetry signal from the collected tracer concentration measurements, where the uplink telemetry signal conveys a downhole tool measurement or communication. The example method also includes performing an operation in response to the recovered uplink telemetry signal.

In at least some embodiments, an example system includes a downhole tool deployed in a borehole, where the downhole tool provides a downhole tool measurement or communication. The example system also includes a downhole telemetry unit that is part of the downhole tool or that is in communication with the downhole tool, where the downhole telemetry unit modulates at least one tracer concentration in a flow stream of the borehole to generate an uplink telemetry signal conveying the downhole tool measurement or communication. The example system also includes at least one tracer sensor to collect tracer concentration measurements as a function of time. The example system also includes a processor that recovers the uplink telemetry signal from the collected tracer concentration measurements. The example system also includes at least one component that performs an operation in response to the recovered uplink telemetry signal.

In at least some embodiments, an example downhole telemetry unit includes a communication interface to receive a downhole tool measurement or communication. The example downhole telemetry unit also includes an encoder that generates a digital signal representing the downhole tool measurement or communication. The example downhole telemetry unit also includes a modulator that modulates at least one tracer concentration in a borehole flow stream based on the digital signal to generate an uplink telemetry signal conveying the downhole tool measurement or communication. Various tracer options, tracer modulation options, downhole tool deployment options, and telemetry response options are described herein.

FIG. 1 is a block diagram showing an illustrative system 10 employing chemical tracers in a flow stream. As shown, the system 10 includes a downhole tool 20 deployed in a borehole or well 12. A telemetry unit 16 is also deployed in the borehole or well 12, and is in communication with the downhole tool 20. While not required, the telemetry unit 16 may be part of the downhole tool 20. In either case, the telemetry unit 16 includes a tracer-based modulator 18 that operates to modulate the concentration of at least one tracer 26 in the flow stream 22 so as to convey an uplink telemetry signal.

Uphole from the telemetry unit 16, tracer sensor(s) 24 collect tracer concentration measurements from the flow stream 22 or from samples collected from the flow stream. The collected tracer concentration measurements are analyzed by a processor (e.g., a processor of the surface interface 30 or computer 40) to recover the uplink telemetry signal from the concentration of at least one tracer 26 as a function of time. To ensure the tracer concentration measurements can recover the uplink telemetry signal, the collected measurements need to be synchronized with the tracer modulation scheme employed by the telemetry unit 16 (i.e., a predetermined modulation clock cycle is used). Another option is to oversample the tracer concentration measurements to ensure the uplink telemetry signal can be recovered.

In different embodiments, the data rate available for tracer-based telemetry is dependent on various parameters such as the fluid flow rate, the depth of the wells, and the diameter of the well. As an example, the data rate for tracer-based telemetry may be a function of the well average linear velocity (flow rate/average cross sectional area), the distance that must be traveled (to surface and/or to tracer sensors), and tracer diffusion/dispersion/dilution during uphole conveyance. Detection limits and detection confidence of available tracer sensors will also affect the data rate. In at least some embodiments, a plurality of spaced sensors can be used to increase tracer detection confidence and/or reduce detection errors. For some tracer sensors, it may be necessary to limit the fluid flow rate.

In a system where many of these variables are unknown, one option is to tune the system by having the transmitter periodically emit two tracer pulses into the flow stream. Initially, the spacing between the two tracer pulses can be selected such that the tracer pulses are easy to detect. Subsequently, the spacing between pulses can be decreased until the detector system signals that the pulses are not detectable. The telemetry system may then test one of the previously detected spacings for a period of time to choose a suitable spacing. As desired, the tuning process can be repeated. Such tuning should account for tracer diffusion/dispersion/dilution effects and ensures the tracer-based telemetry data rate is maximized. At some flow rates (high or low), tracer diffusion/dispersion/dilution may increase (reducing detectability of tracers). Accordingly, the tuning process may include flow rate adjustments.

In accordance with at least some embodiments, the uplink telemetry signal is recovered from the collected tracer concentration measurements using a processor. For example, the processor can detect a header field (e.g., a start bit or start sequence) of the uplink telemetry signal from the collected tracer concentration measurements and then use a predetermined modulation clock cycle to recover information from a subsequent data field of the uplink telemetry signal. If oversampled tracer concentration measurements are available, the processor may be able to analyze the measurements to recover the uplink telemetry signal without relying on the predetermined modulation clock cycle.

As previously noted, the processor may be part of a surface interface 30 or a computer 40 in communication with tracer sensor(s) 24. For example, each tracer sensor 24 may produce an electrical signal or optical signal that indicates the concentration of a particular tracer at different time intervals (e.g., at time x, at time x+1, at time x+2, etc.). The electrical signal or optical signal may be provided to the surface interface 30 via an electrical conductor or optical fiber that passes through the wellhead 14. As needed, the tracer sensor(s) 24 may include signal transducer components to convert a sensor output to another signal format (e.g., electrical to optical, optical to electrical, electrical to acoustic). While the tracer sensor(s) 24 are represented as being in the borehole or well 12, it should be appreciated that tracer sensor(s) 24 may additionally or alternatively be integrated with a fluid conduit that carries the fluid produced by the well to a storage facility. In other words, tracer sensor(s) 24 can be added to any fluid conduits (i.e., the borehore/well 12, the wellhead 14, or other conduits) that convey the flow stream 22 carrying the modulated tracer concentrations. Once the surface interface 30 receives the tracer concentration measurements from the tracer sensor(s) 24, the surface interface 30 analyzes the tracer concentration measurements to recover the uplink telemetry signal. The uplink telemetry signal can then be conveyed from the surface interface 30 to the computer 40 for further analysis and response operations. Alternatively, the surface interface 30 may provide the tracer concentration measurements to the computer 40, whereby the computer 40 is able to recover the uplink telemetry signal. As needed, the surface interface 30 can adjust the signal format of the tracer concentration measurements (e.g., optical to electrical or other format conversions).

In at least some embodiments, the computer system 40 includes a processing unit 42 that receives or recovers the uplink telemetry signal as described herein. The processing unit 42 may interpret the uplink telemetry signal and perform an operation in response. For example, the processing unit 42 may cause a downhole tool measurement, data log, or communication to be displayed to an operator (e.g., via output device 44) in response to the uplink telemetry signal. Additionally or alternatively, the processing unit 42 may cause an audio or visual alert to be presented to an operator in response to the uplink telemetry signal. Additionally or alternatively, the processing unit 42 may provide drilling trajectory updates or messages in response to the uplink telemetry signal. Additionally or alternatively, the processing unit 42 may initiate operations that provide downlink control signals 34 to the downhole tool 20 and/or a flow control device (FCD) 32 in the borehole/well 12. For example, downlink control signals 34 may cause the FCD 32 to adjust a flow rate in the borehole/well 12. Meanwhile, other downlink control signals 34 may cause the downhole tool 20 to adjust its operations or operational parameters. In at least some embodiments, the downlink control signals 34 are conveyed to the downhole tool 20 and/or flow control device (FCD) 32 using wireless telemetry options such as acoustic telemetry, pressure pulse telemetry, or wireless EM telemetry, or a combination thereof. Different operations performed in response to the uplink telemetry signal can be automated or can be based on input from an operator that reviews the information obtained from the uplink telemetry signal.

To analyze the uplink telemetry signal and/or to perform operations in response For example, the processing unit 42 may execute software or instructions obtained from a local or remote non-transitory computer-readable medium 48. The computer system 40 also may include input device(s) 46 (e.g., a keyboard, mouse, touchpad, etc.) and output device(s) 44 (e.g., a monitor, printer, etc.). Such input device(s) 46 and/or output device(s) 44 provide a user interface that enables an operator to interact with available tools and/or software executed by the processing unit 42. For example, the computer system 40 may enable an operator to select downhole operations, to view collected measurements or logs provided by uplink telemetry signals, to view analysis results, and/or to perform other tasks.

Figure 2:
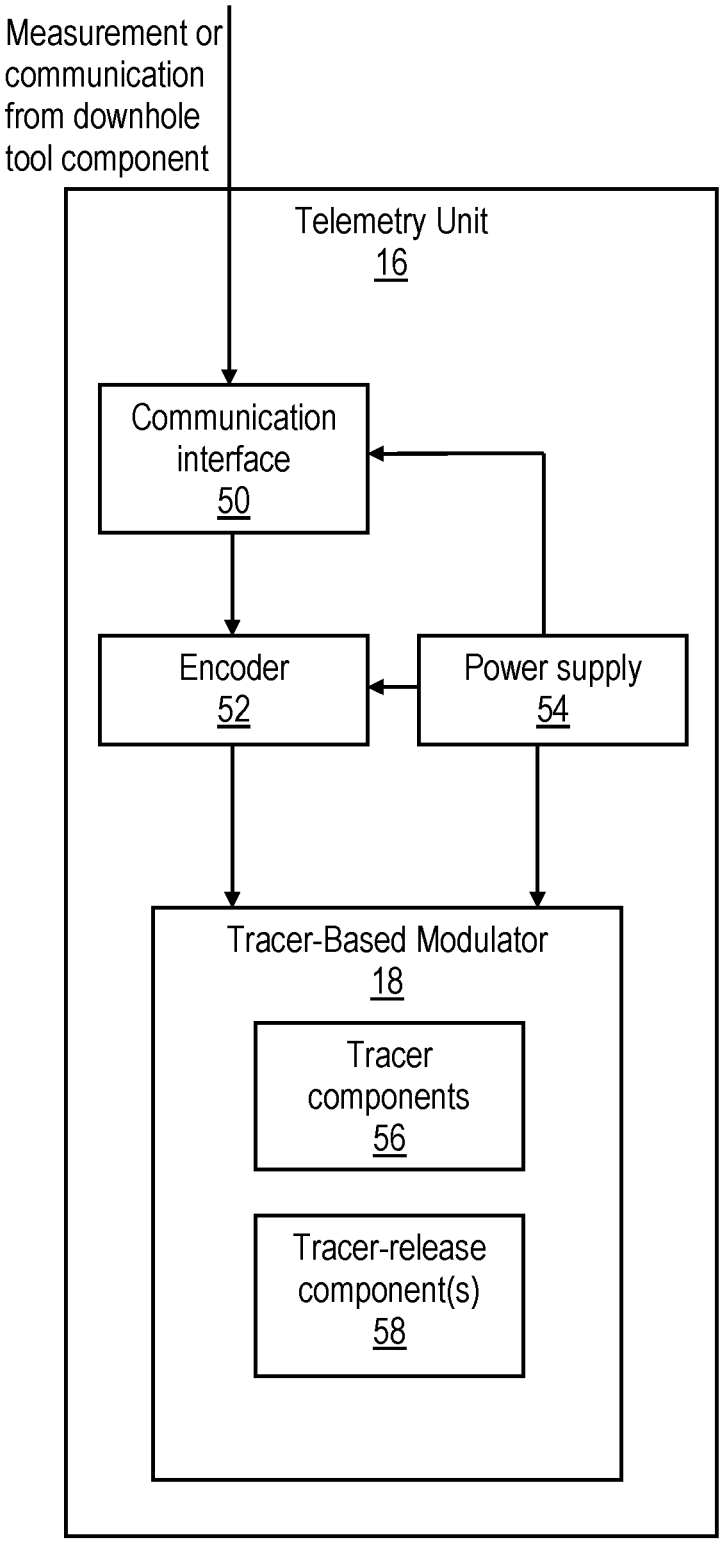
FIG. 2 is a block diagram showing components of an illustrative telemetry unit to modulate a flow stream with chemical tracers.

FIG. 2 is a block diagram showing components of telemetry unit 16, which selectively operates to modulate the concentration of one or more tracers in a borehole or well flow stream. As previously noted, the telemetry unit 16 may be part of the downhole tool 20 or may be separate from the downhole tool 20. If separate, the telemetry unit 16 is in communication with the downhole tool 20 using available wired or wireless communication techniques. As shown, the telemetry unit 16 includes a communication interface 50 that receives a measurement or communication from a downhole tool component. The received measurement or communication is provided to an encoder 52 that encodes the measurement or communication as a digital signal (e.g., one or more multi-bit digital signals). The encoder 52 may correspond to, for example, a processor, circuitry, or logic components configured to provide a digital signal based on a received measurement or communication from a downhole tool component. The digital signal is provided to a tracer-based modulator 18 that includes tracer components 56 and tracer-release component(s) 58. The tracer components 56 correspond to tracers or the ingredients for tracers in gas, liquid, or solid form. In some embodiments, the tracer components 56 correspond to encapsulated tracers or ingredients. The tracer-release component(s) 58 uses the digital signal as the modulation pattern for releasing one or more tracers into the flow stream 22 in a controlled manner as a function of time.

Different tracer components 56 and tracer-release components 58 are possible. Example tracer components 56 include, but are not limited to, tracer doped polymer rods and tracers in gas, liquid, or solid form. Different tracers may be compatible for conveyance by a water-phase fluid, an oil-phase fluid, or a gas. Suitable tracers include, for example, water-phase alcohols, esters, and fluorescein group molecules. Other suitable tracers include, for example, oil phase α-olefins (with double bond not found in naturally occurring oils reservoir fluids), quinones, halogenated hydro carbons (gas phase acetylene).

Example tracer-release components 58 include, but are not limited to, a heater element, a port element on an exterior surface of the telemetry unit 20, an electrolysis element or catalytic element, at least one actuator to break tracer capsules, a pressurized gas container and valve. More specifically, the heater element is able to release tracers from a tracer component in a controlled manner by selectively applying heat to the tracer component. Meanwhile, a port element is able to release tracers in a controlled manner by selectively opening or closing the port (i.e., a cover or seal) for an interior channel that houses tracers. When the port is open, tracers are released into the flow stream 22. In at least some embodiments, an electrolysis element is able to release tracers from a tracer component in a controlled manner by selectively applying electricity to the tracer component. Meanwhile, a catalytic element is able to release tracers from a tracer component in a controlled manner by selectively applying a chemical catalyst to the tracer component. Further, at least one actuator is able to release tracers from a tracer component in a controlled manner by selectively crushing or applying pressure to the tracer component. As another example, a pressurized gas container and valve is able to release tracers from a tracer component in a controlled manner by selectively releasing pressurized gas to eject the tracer component.

The different tracer-release components 58 may need power to operate. Accordingly, the telemetry unit 16 may include a power supply 54 that provides power to the tracer-based modulator 18. The power supply 54 can also provide power to components of the encoder 52 and/or the communication interface 50. Example power supplies include, but are not limited to, a battery, an onboard generator, a piezo fishtail, a micro-turbine, or a radioisotope thermoelectric generator (RTG). In some embodiments, the power supply 54 uses an available flow stream to generate power. In such case, at least part of the power supply 54 would be external to a housing of the telemetry unit 16.

Figure 3A:
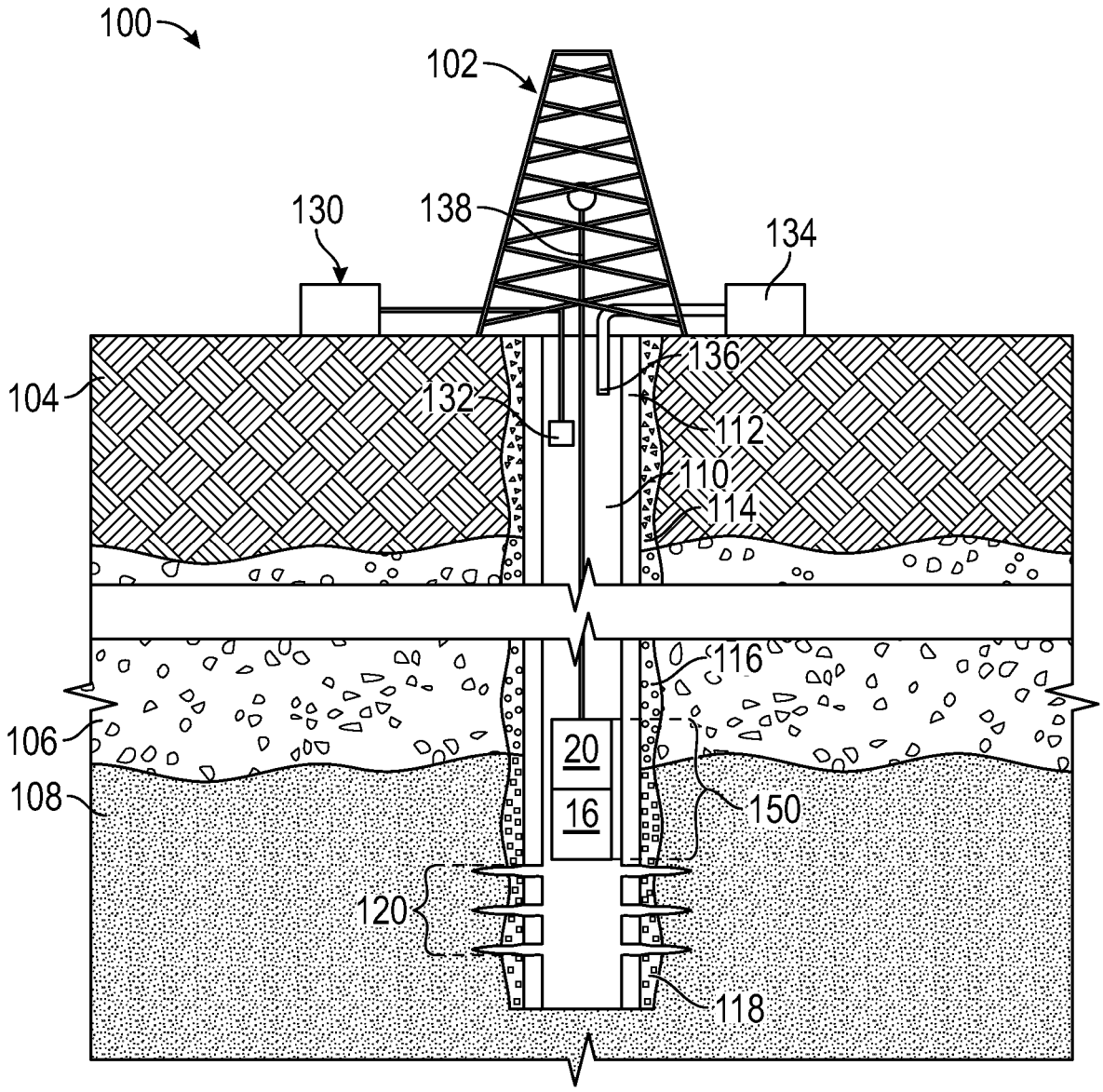
FIG. 3A is a schematic diagram showing an illustrative slickline deployment scenario, where the telemetry unit of FIGS. 1 and 2 is deployed in a borehole via slickline.

FIG. 3A is a schematic diagram showing an illustrative slickline deployment scenario 100, where the telemetry unit 16 is deployed via slickline. In FIG. 3A, a rig 102 and a slickline 138 are used to support raising and lowering a tool string 150 in a cased well 110, where the tool string 150 includes the downhole tool 20 and the telemetry unit 16 described previously. The borehole 110 may extend through different formation layers 104, 106, and 108. In scenario 100, the cased well 110 includes a casing string 112. In at least some embodiments, cementing operations have been completed to help maintain the integrity of the cased well 110. Also, perforations 120 that facilitate fluid flow from the formation layer 108 to an interior channel of the casing string 112 are represented. In at least some embodiments, the cementing operations involve providing different tracer-based cement sections 114, 116, and 118 to facilitate identifying which of the different formation layers 104, 106, and 108 are sourcing produced fluid. When tracer-based cement is used downhole (e.g., as is the case for cement sections 114, 116, and 118), the tracer modulation scheme employed by the telemetry unit 16 may avoid interference by using different tracers than those used for the tracer-based cement sections 114, 116, and 118.

In FIG. 3A, a tracer sensor 132 and a surface interface 130 are represented, where the tracer sensor 132 and the surface interface 130 perform the same operations as the tracer sensor(s) 24 and surface interface 30 described for FIG. 1. To summarize, the tracer sensor 132 collects tracer concentration measurements in a flow steam of the cased well 110 as a function of time. In scenario 100, the cased well 110 may be used for production. More specifically, an upward flow stream in the cased well 110 may result from fluid flow entering the cased well 110 through the perforations 120 and moving upward towards earth's surface. Near earth's surface one or more fluid conduits 136 may direct produced fluid to a storage facility 134. As fluid flows upward through the cased well 110, the telemetry unit 16 is able to modulate tracer concentrations in the flow stream to convey uplink telemetry signals corresponding to a measurement or communication from the downhole tool 20 as described herein. In the slickline deployment scenario 100, the telemetry unit 16 can perform tracer-based modulation to convey of an uplink telemetry signal as described herein even if a continuous electrical conductor is not available downhole.

While the downhole tool 20 is represented as being part of the tool string 150 in scenario 100, it should be appreciated some downhole tools 20 may be integrated with or attached to the casing string 112. In such case, the tool string 150 still includes the telemetry unit 16, where the telemetry unit 16 provides tracer-based modulation to convey uplink telemetry signals for a downhole tool 20 that is permanently installed with the casing string 112. In such case, the downhole tool 20 and telemetry unit 16 may each include their own power supply. Alternatively, power can be shared from the downhole tool 20 to the telemetry unit 16 or vice versa using inductive coils, capacitive pads, galvanic contact points, connectors, power generators, and power storage units (e.g., capacitors or batteries).

Figure 3B:
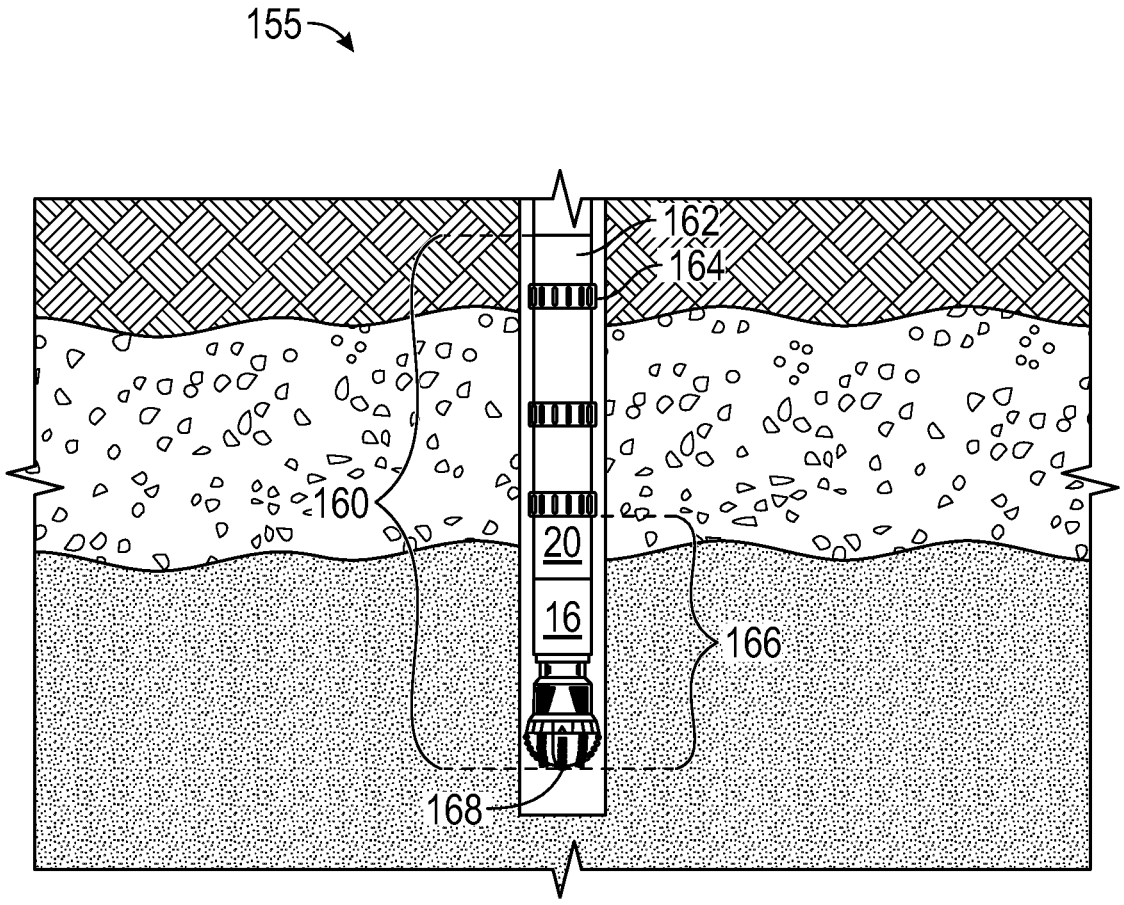
FIG. 3B is a schematic diagram showing an illustrative drill string deployment scenario, where the telemetry unit of FIGS. 1 and 2 is deployed in a borehole as part of a drill string.

FIG. 3B is a schematic diagram showing an illustrative drill string deployment scenario 155, where the telemetry unit 16 is deployed as part of a drill string 160. In scenario 155, the drill string 160 is built by joining a plurality of tubular sections 162 with connectors (collars) 164. At the lower end of the drill string 160, a bottomhole assembly (BHA) 166 is represented. The BHA 166 includes a drill bit 168, one or more downhole tools 20 and the telemetry unit 16. During drilling operations, drilling mud is circulated using an interior passage of the drill string 160 and the annular space between of the borehole being drilled and the drill string 160. Accordingly, the telemetry unit 16 can modulate the concentration of at least one tracer conveyed by the drilling mud being circulated to convey uplink telemetry signals from the downhole tool 20. At or near earth's surface, tracer concentration measurements can be collected and analyzed to recover uplink telemetry signals as described herein. If the same drilling mud is to be circulated more than once, a tracer filter or multiple tracers can be used to ensure uplink telemetry signals can continue to be recovered without interference from previous tracer-based modulations. In the drills string deployment scenario 155, the telemetry unit 16 can perform tracer-based modulation to convey of an uplink telemetry signal as described herein even if a continuous electrical conductor is not available downhole.

Figure 3C:
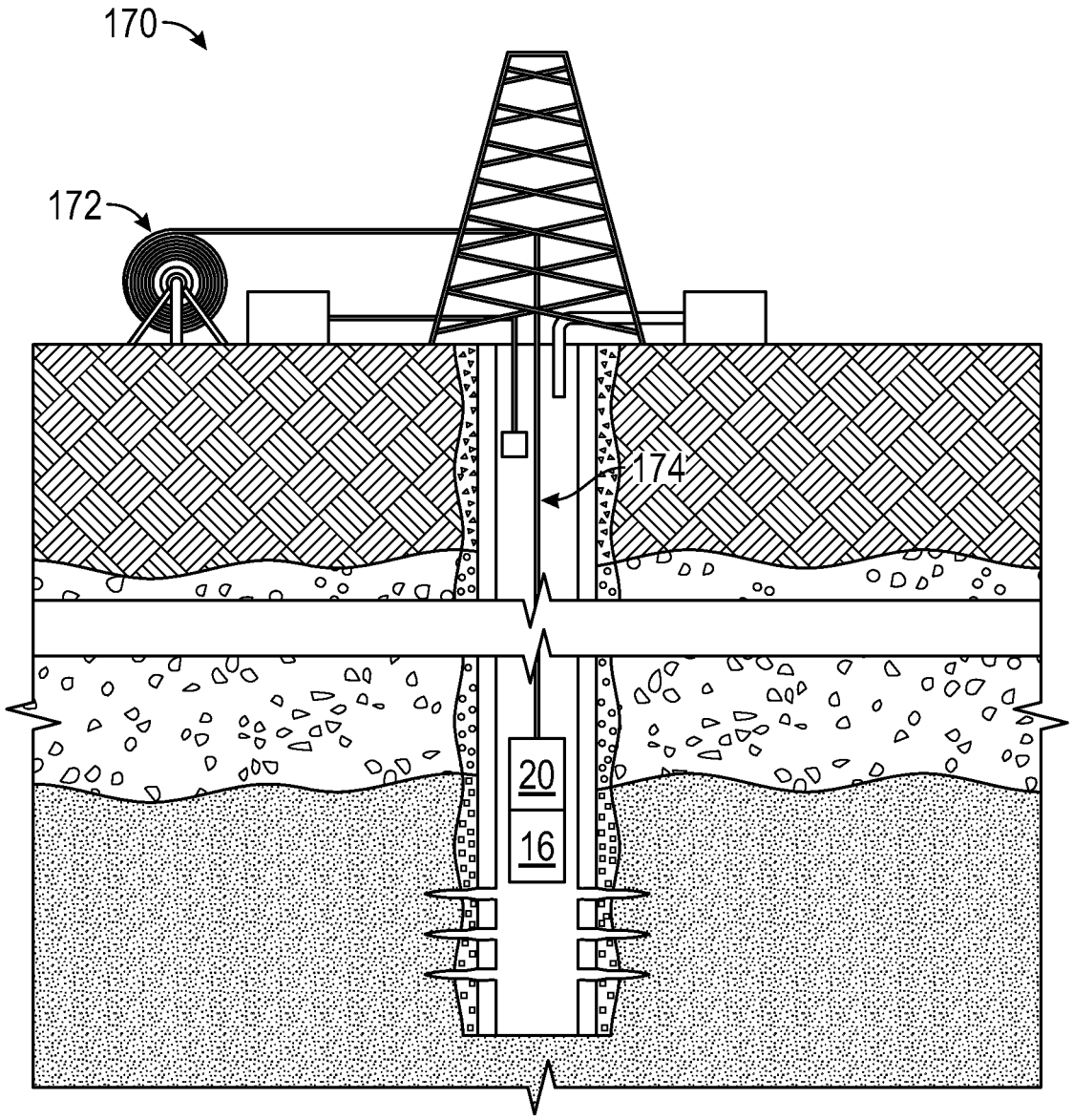
FIG. 3C is a schematic diagram showing an illustrative coiled tubing deployment scenario, where the telemetry unit of FIGS. 1 and 2 is deployed in a borehole via coiled tubing.

FIG. 3C is a schematic diagram showing an illustrative coiled tubing deployment scenario 170, where the telemetry unit 16 is deployed using coiled tubing 174. In scenario 170, a rig and coiled tubing 174 from a reel 172 are used to lower and raise the downhole tool 20 and the telemetry unit 16. While the downhole tool 20 is represented as being part of a tool string in scenario 170, it should be appreciated some downhole tools 20 may be integrated with or attached to a casing string. In such case, the telemetry unit 16 can be deployed using the coiled tubing 174, where the telemetry unit 16 provides tracer-based modulation to convey uplink telemetry signals for a downhole tool 20 that is permanently installed with the casing string. In such case, the downhole tool 20 and telemetry unit 16 may each include their own power supply. Alternatively, power can be shared from the downhole tool 20 to the telemetry unit 16 or vice versa using inductive coils, capacitive pads, galvanic contact points, connectors, power generators, and power storage units (e.g., capacitors or batteries). In the coiled tubing deployment scenario 174, the telemetry unit 16 can perform tracer-based modulation to convey of an uplink telemetry signal as described herein even if a continuous electrical conductor is not available downhole.

Figure 3D:
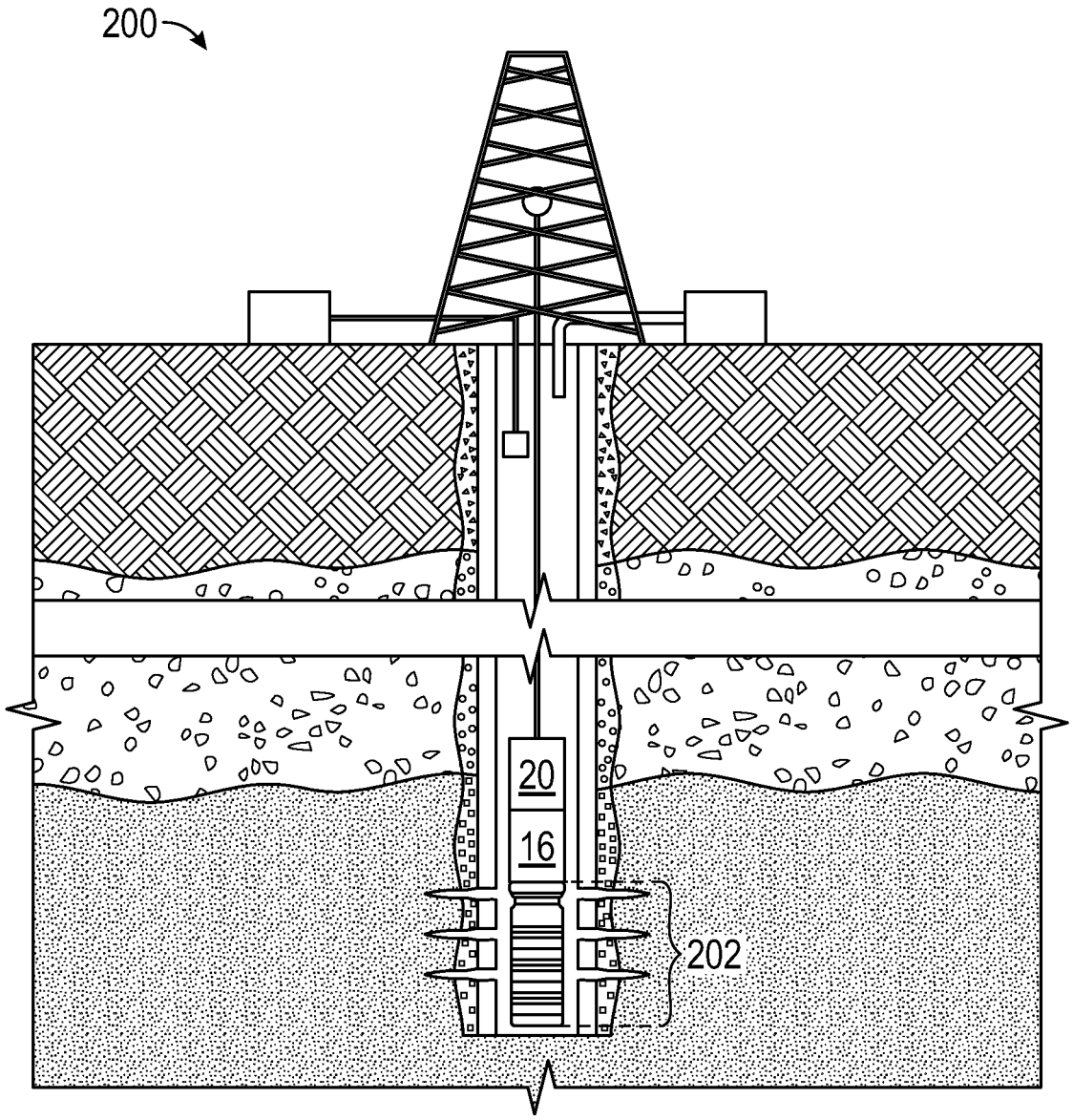
FIG. 3D is a schematic diagram showing an illustrative gas-lift mandrel tool string deployment scenario, where the telemetry unit of FIGS. 1 and 2 is deployed in a borehole as part of a gas-lift mandrel tool.

FIG. 3D is a schematic diagram showing an illustrative gas-lift mandrel tool string deployment scenario 200, where the telemetry unit 16 is deployed in a borehole as part of a gas-lift mandrel tool string 202. The downhole tool 20 can be part of the gas-lift mandrel tool string 202. In different embodiments, the gas-lift mandrel tool string 202 can be deployed, for example, via slickline or coiled tubing. In the gas-lift mandrel tool string deployment scenario 200, the telemetry unit 16 can perform tracer-based modulation to convey of an uplink telemetry signal as described herein even if a continuous electrical conductor is not available downhole.

In some embodiments, a wireline could be used to deploy the downhole tool 20 and/or the telemetry unit 16. With a wireline, a continuous electrical conductor is available to convey power and telemetry. Accordingly, the telemetry unit 16 may perform tracer-based modulation to convey of an uplink telemetry signal only as needed (e.g., to supplement or provide redundancy for other telemetry options). In general, the tracer-based modulation techniques described herein can be used independently from or in combination with other telemetry options.

Figure 3E:
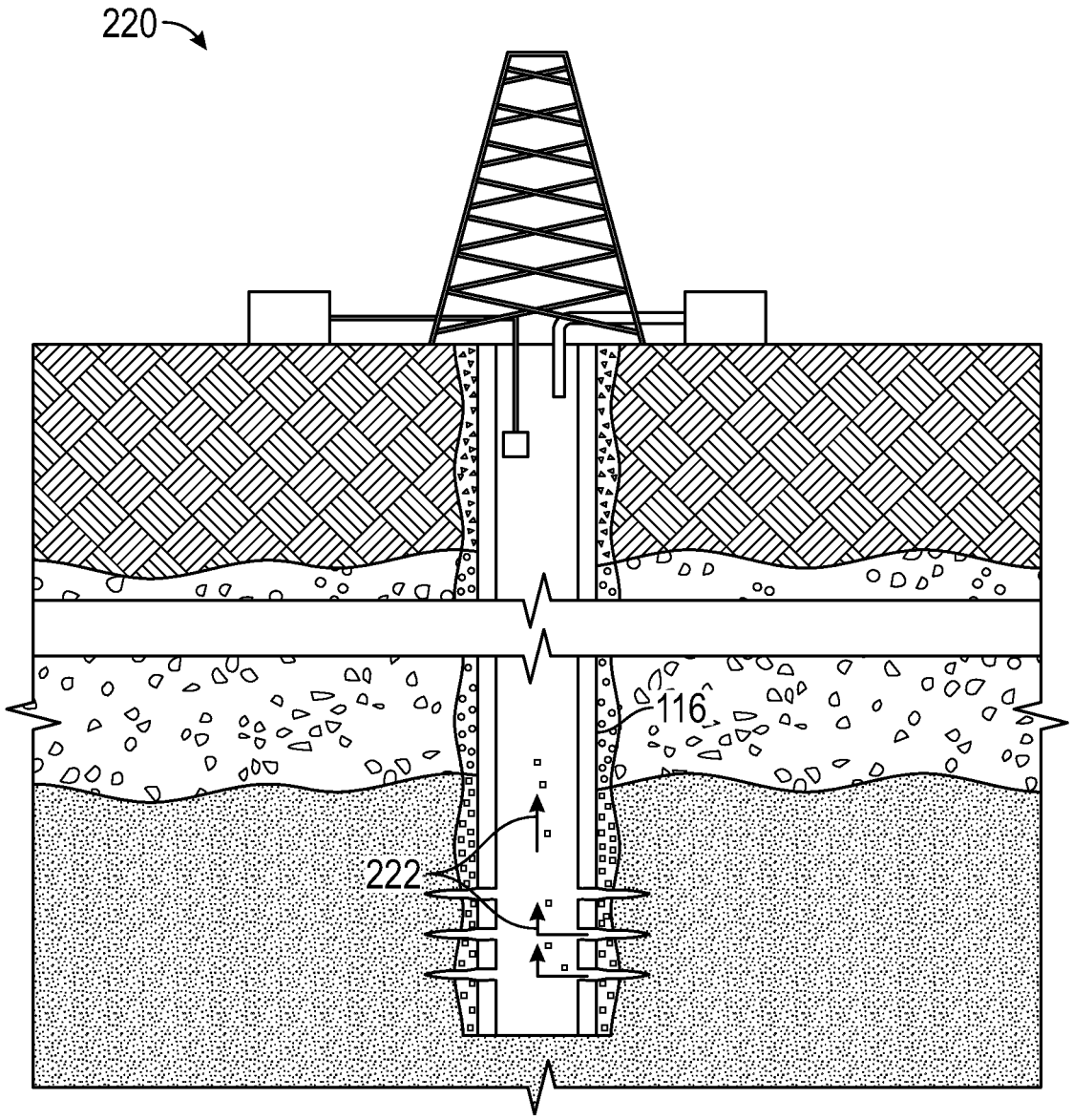
FIG. 3E is a schematic diagram showing an illustrative downhole environment, where chemical tracers are released from cement in a borehole.

FIG. 3E is a schematic diagram showing an illustrative downhole environment 220, where tracers are released from cement in a borehole. In the downhole environment 220, tracers 116 are released from cement independently of the tracer-based modulation scheme described herein. For scenarios where tracers are released from cement or other sources independently from the tracer-based modulation schemes described, different tracers can be used to avoid interference. Alternatively, the tracer concentration level used for tracer-based modulation can be adjusted as needed to ensure there is detectable difference between a default tracer concentration level (due to tracers from other sources-comparable to white noise) and tracers that convey uplink telemetry signals. The analysis of tracers from other sources may be adjusted to account for the tracer-based modulation scheme (by ignoring or accounting for tracers used for uplink telemetry signaling).

Figure 4:
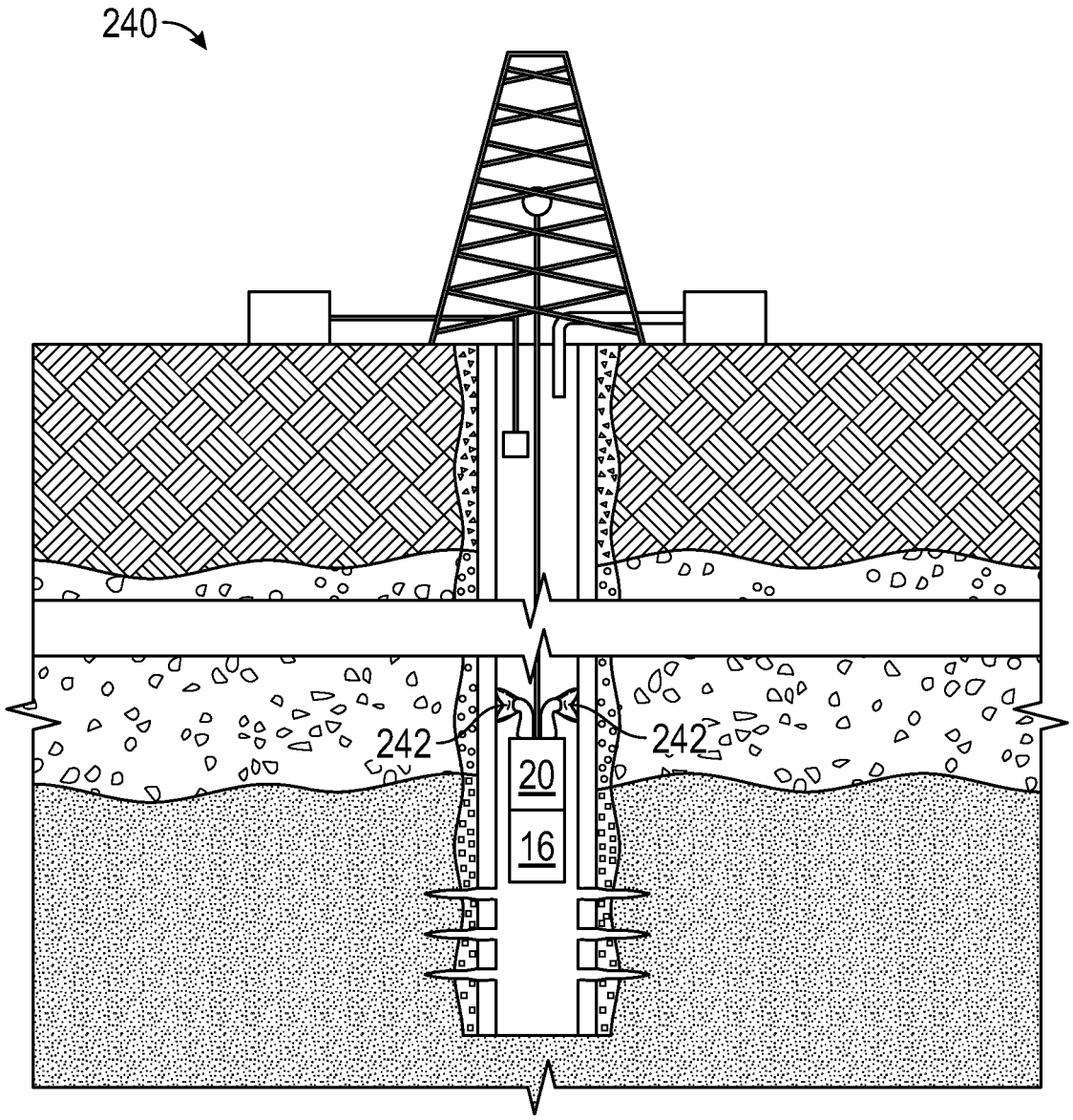
FIG. 4 is a schematic diagram showing an illustrative downhole environment, where the telemetry unit of FIGS. 1 and 2 receives power from a piezo fishtail power source.

FIG. 4 is a schematic diagram showing an illustrative downhole environment 240, where the telemetry unit 16 and/or the downhole tool 20 receives power from a piezo fishtail power source 242. The piezo fishtail power source 242 takes advantage of the available flow stream in the downhole environment 240 to generate power. The generated power can be used to perform the tracer-based modulation operations described herein. The generated power may enable the downhole tool 20 to collect measurements, to perform health monitoring operations, and to provide measurements or communications to the telemetry unit 16. Another option for generating power for the telemetry unit 16 and/or the downhole tool 20 using an available flow stream is a mini-turbine. Power generated by the piezo fishtail power source 242 and/or a mini-turbine may be sufficient to power the operations of the downhole tool 20 and telemetry unit 16. Alternatively, power generated by a piezo fishtail power source 242 and/or a mini-turbine may supplement a remote power supply provided with the telemetry unit 16 and/or the downhole tool 20.

Figure 5A:
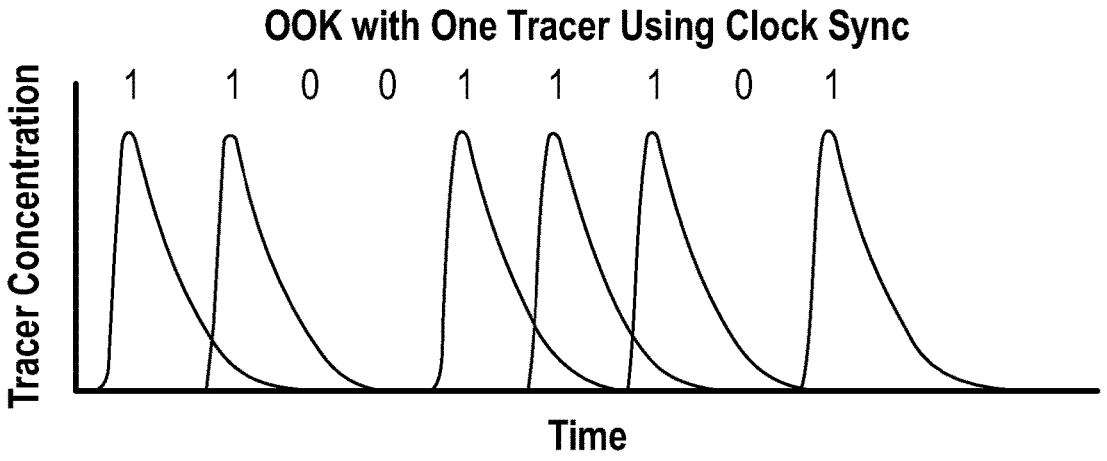
FIG. 5A is a chart showing an illustrative on-off keying (00K) modulation scheme for tracers.

FIG. 5A is a chart showing an illustrative on-off keying (OOK) modulation scheme for tracers. In the OOK modulation scheme of FIG. 5A, the concentration of a single tracer is modulated as a function of time to provide an uplink telemetry signal corresponding to a multi-bit binary code "110011101". The interpretation of a multi-bit binary code such as 110011101 may vary. The communication protocol can be updated as needed to provide more information or less information in the uplink telemetry signals (e.g., depending on the data bandwidth available, the amount of power available, the amount of tracers available, etc.). The clock rate used for OOK modulation may vary. It is expected that a data rate of 1 bit/5 minutes can be supported.

Figure 5B:
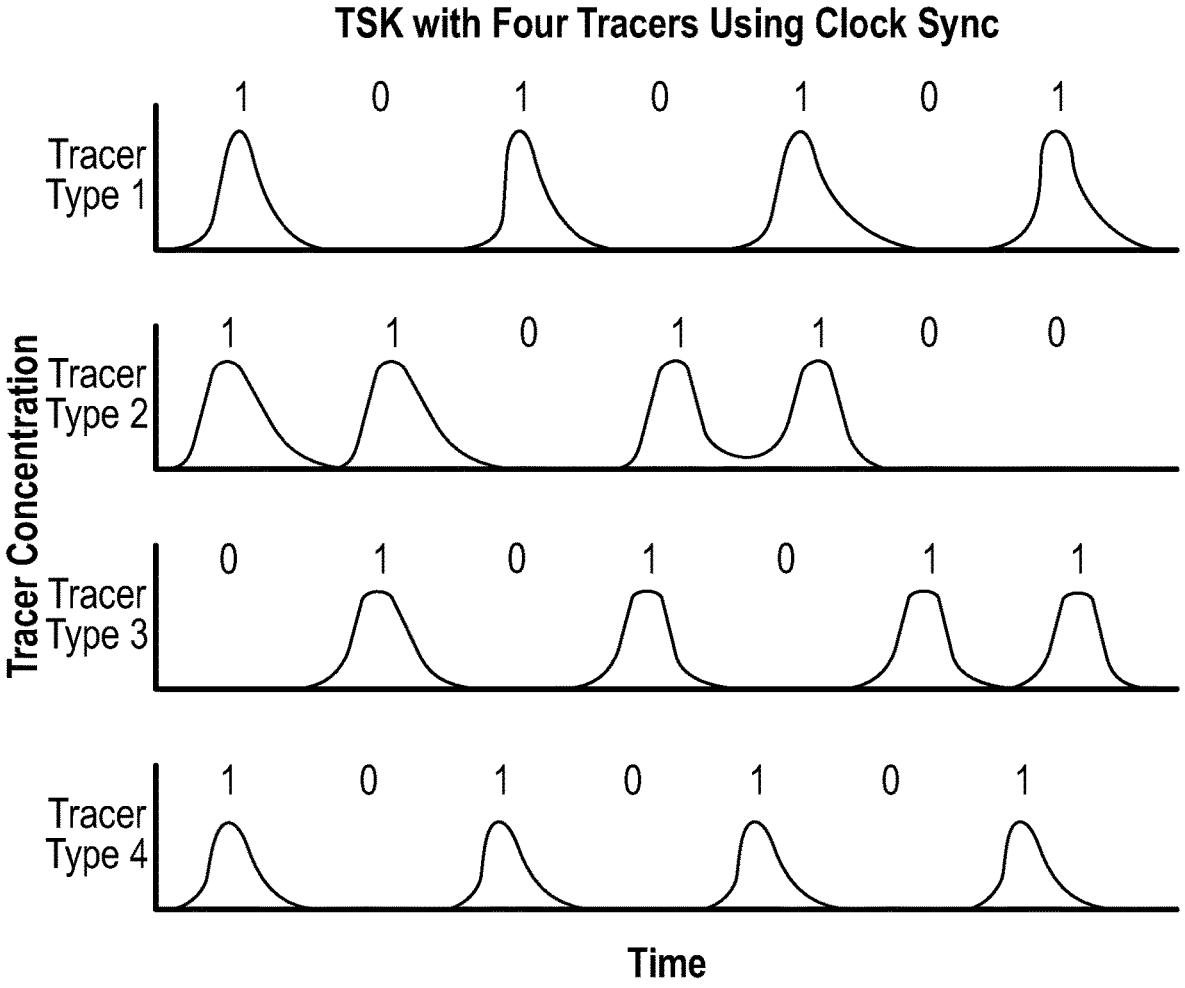
FIG. 5B is a chart showing an illustrative tracer shift keying (TSK) modulation scheme.

FIG. 5B is a chart showing an illustrative tracer shift keying (TSK) modulation scheme. For the TSK modulation scheme of FIG. 5B, the concentration of four different tracers are modulated as a function of time. More specifically, the concentration of tracer type 1 is modulated as a function of time to provide an uplink telemetry signal corresponding to a multi-bit binary code "1010101". Also, the concentration of tracer type 2 is modulated as a function of time to provide an uplink telemetry signal corresponding to a multi-bit binary code "1101100". Also, the concentration of tracer type 3 is modulated as a function of time to provide an uplink telemetry signal corresponding to a multi-bit binary code "0101011". Also, the concentration of tracer type 4 is modulated as a function of time to provide an uplink telemetry signal corresponding to a multi-bit binary code "1010101". The above-noted binary code examples for the four tracer types assume a serial data communication protocol, where each tracer type provides a serial multi-bit binary code (e.g., 4 binary codes, each with 7 bits).

Another option is to use a parallel data communication protocol, where each tracer type received at the same time (within the same clock cycle) is interpreted together. In such case, the multi-bit binary codes are "1101" at time interval 1, "0110" at time interval 2, "1001 at time interval 3, "0110" at time interval 4, "1101" at time interval 5, "0010" at time interval 6, and "1011" at time interval 7 (7 binary codes, each with 4 bits). Regardless of the particular scheme used (i.e., parallel versus serial data), the interpretation of multi-bit binary codes for each tracer type may vary. The communication protocol can be updated as needed to provide more information or less information in the uplink telemetry signals (e.g., depending on the data bandwidth available, the amount of power available, the amount of tracers available, etc.). While modulation examples using 1 tracer (as in FIG. 5A) and 4 tracers (as in FIG. 5B) have been provided, it should be appreciated that the number of tracers used may vary. As desired, different modulation schemes such as OOK and TSK can be combined by using different tracers for each scheme or by recognizing multiple tracer concentration levels (level 1, level 2, level 3, etc.).

Figure 5C:
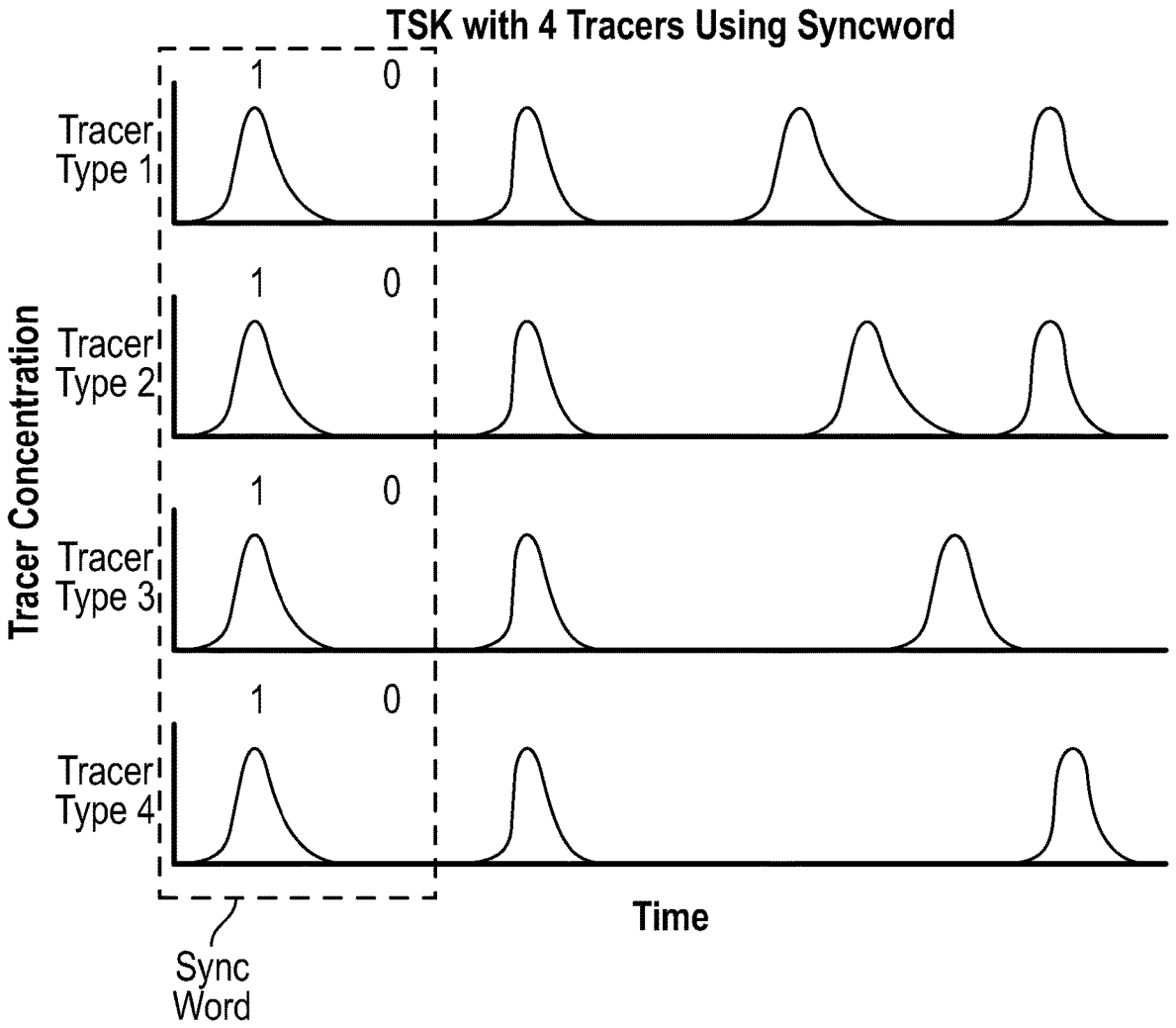
FIG. 5C is a chart showing an illustrative sync word used with the TSK modulation scheme.

FIG. 5C is a chart showing an illustrative sync word used with a TSK modulation scheme. As shown, the sync word corresponds to all of the 4 types of tracers having the concentration pattern "10" for time intervals 1 and 2. The sync word may vary in different embodiments. Once a sync word is detecting, the communication protocol may interpret a subsequent number of bits as a data field or data type field, etc.

Figure 6:
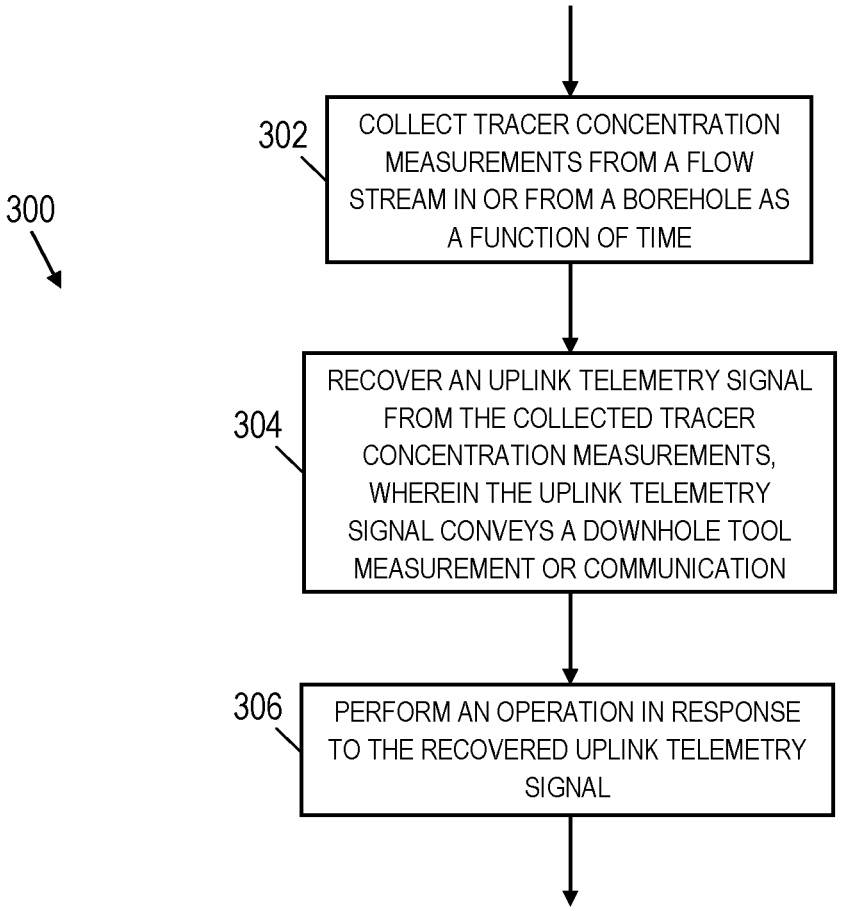
FIG. 6 is a flowchart showing an illustrative method related to tracer-based telemetry.

FIG. 6 is a flowchart showing an illustrative method 300 related to tracer-based telemetry. At block 302, the method 300 comprises collecting tracer concentration measurements for a flow stream in or from a borehole as a function of time. At block 304, an uplink telemetry signal is recovered from the collected tracer concentration measurements, where the uplink telemetry signal conveys a downhole tool measurement or communication. At block 306, an operation is performed in response to the recovered uplink telemetry signal. The operation may correspond to a computer performing a display or messaging operation, an alert operation, a drilling guidance operation, and/or a production control operation. In some embodiments, the operation may involve a selection from an operator in response to the uplink telemetry signal. Alternatively, the operation may be automated. The operation may involve transmitting a downlink control signal to a downhole tool (e.g., downhole tool 20) or another component (e.g., FDC 32). Available telemetry options for conveying a downlink telemetry signal include acoustic telemetry, pressure pulse telemetry, or other telemetry options. Again, it should be appreciated that the tracer-based telemetry techniques described herein can be used independently or in combination with other telemetry techniques.

Embodiments disclosed herein include:

A. A method that comprises collecting tracer concentration measurements from a flow stream in or from a borehole as a function of time. The method also comprises recovering an uplink telemetry signal from the collected tracer concentration measurements, wherein the uplink telemetry signal conveys a downhole tool measurement or communication. The method also comprises performing an operation in response to the recovered uplink telemetry signal.

B. A system that comprises a downhole tool deployed in a borehole, wherein the downhole tool provides a downhole tool measurement or communication. The system also comprises a downhole telemetry unit that is part of the downhole tool or that is in communication with the downhole tool, wherein the downhole telemetry unit modulates at least one tracer concentration in a flow stream of the borehole to generate an uplink telemetry signal conveying the downhole tool measurement or communication. The system also comprises at least one tracer sensor to collect tracer concentration measurements from the flow stream as a function of time. The system also comprises a processor that recovers the uplink telemetry signal from the collected tracer concentration measurements. The system also comprises at least one component that performs an operation in response to the recovered uplink telemetry signal.

C. A downhole telemetry unit that comprises a communication interface to receive a downhole tool measurement or communication. The downhole telemetry unit also comprises an encoder that generates a digital signal representing the downhole tool measurement or communication. The downhole telemetry unit also comprises a modulator that modulates at least one tracer concentration in a borehole flow stream based on the digital signal to generate an uplink telemetry signal conveying the downhole tool measurement or communication.

Each of embodiments A, B, and C may have one or more of the following additional elements in any combination: Element 1: further comprising transmitting downlink telemetry signals to the downhole tool using acoustic or pressure pulses. Element 2: further comprising generating the uplink telemetry signal by encoding the downhole tool measurement or communication as a digital signal and by modulating at least one tracer concentration in the flow stream based on the digital signal. Element 3: wherein modulating at least one tracer concentration in the flow stream comprises releasing a plurality of different tracers in a predetermined pattern. Element 4: wherein modulating at least one tracer concentration in the flow stream comprises changing at least one tracer concentration at a predetermined time interval. Element 5: wherein performing an operation comprises displaying at least one of a measurement, a log, and a message on a computer display. Element 6: wherein performing an operation comprises generating a control signal for the downhole tool or another downhole component.

Element 7: wherein the downhole telemetry unit is deployed in the borehole via slickline or coiled tubing. Element 8: wherein the downhole telemetry unit is deployed in the borehole as part of a drill string. Element 9: wherein the downhole telemetry unit is deployed in the borehole as part of a gas-lift mandrel. Element 10: wherein the at least one component comprises a computer that performs a display or alert operation in response to the recovered uplink telemetry signal. Element 11: wherein the at least one component comprises a downhole flow control device that is directed to perform a flow adjustment operation in response to the recovered uplink telemetry signal.

Element 12: wherein the modulator comprises at least one tracer-release component that is controlled by the digital signal. Element 13: wherein the at least one tracer-release component comprises a heater element. Element 14: wherein the at least one tracer-release component comprises a port element on an exterior surface of the telemetry unit. Element 15: wherein the at least one tracer-release component comprises an electrolysis element or catalytic element. Element 16: wherein the at least one tracer-release component comprises tracer capsules and at least one actuator to break tracer capsules. Element 17: wherein the at least one tracer-release component comprises a pressurized gas container and a valve. Element 18: further comprising a power supply that provides power to the modulator.

Numerous other modifications, equivalents, and alternatives, will become apparent to those skilled in the art once the above disclosure is fully appreciated. For example, while the disclosed embodiments describe tracer-based modulation for uplink telemetry signaling to earth's surface, the same or similar tracer-based modulation components, detection components, and analysis can be employed by different downhole tools to communicate. In other words, communication with earth's surface is not a requirement. For example, any downhole tool that is uphole relative to another downhole tool could receive, interpret, and perform an operation in response to an uplink telemetry signal involving tracer-based modulation as described herein. Example operations that may be performed by a downhole tool include monitoring ambient parameters, well completion operations, well intervention operations, flow control, etc. It is intended that the following claims be interpreted to embrace all such modifications, equivalents, and alternatives where applicable.

What is claimed is:

1. A method that comprises:

collecting tracer concentration measurements from a flow stream in or from a borehole as a function of time;

recovering an uplink telemetry signal from the collected tracer concentration measurements, wherein:

the collected tracer concentration measurements are synchronized with a tracer modulation scheme; and the uplink telemetry signal conveys a downhole tool measurement or communication; and performing an operation in response to the recovered uplink telemetry signal.

2. The method of claim 1, further comprising transmitting downlink telemetry signals to the downhole tool using acoustic or pressure pulses.

3. The method of claim 1, further comprising generating the uplink telemetry signal by encoding the downhole tool measurement or communication as a digital signal and by modulating at least one tracer concentration in the flow stream based on the digital signal according to the tracer modulation scheme.

4. The method of claim 3, wherein modulating at least one tracer concentration in the flow stream comprises releasing a plurality of different tracers in a predetermined pattern.

5. The method of claim 3, wherein modulating at least one tracer concentration in the flow stream comprises changing at least one tracer concentration at a predetermined time interval.

6. The method of claim 1, wherein performing an operation comprises displaying at least one of a measurement, a log, and a message on a computer display.

7. The method of claim 1, wherein performing an operation comprises generating a control signal for the downhole tool or another downhole component.

8. A system that comprises:

a downhole tool deployed in a borehole, wherein the downhole tool provides a downhole tool measurement or communication;

a downhole telemetry unit that is part of the downhole tool or that is in communication with the downhole tool, wherein the downhole telemetry unit modulates at least one tracer concentration in a flow stream of the borehole by synchronizing the at least one tracer concentration with a tracer modulation scheme employed by the downhole telemetry unit to generate an uplink telemetry signal conveying the downhole tool measurement or communication;

at least one tracer sensor to collect tracer concentration measurements from the flow stream as a function of time;

a processor that recovers the uplink telemetry signal from the collected tracer concentration measurements that are synchronized with the tracer modulation scheme; and at least one component that performs an operation in response to the recovered uplink telemetry signal.

9. The system of claim 8, wherein the downhole telemetry unit is deployed in the borehole via slickline or coiled tubing.

10. The system of claim 8, wherein the downhole telemetry unit is deployed in the borehole as part of a drill string.

11. The system of claim 8, wherein the downhole telemetry unit is deployed in the borehole as part of a gas-lift mandrel.

12. The system of claim 8, wherein the at least one component comprises a computer that performs a display or alert operation in response to the recovered uplink telemetry signal.

13. The system of claim 8, wherein the at least one component comprises a downhole flow control device that is directed to perform a flow adjustment operation in response to the recovered uplink telemetry signal.

14. A downhole telemetry unit that comprises:

a communication interface to receive a downhole tool measurement or communication;

an encoder that generates a digital signal representing the downhole tool measurement or communication; and a modulator that modulates at least one tracer concentration in a borehole flow stream based on the digital signal by synchronizing the at least one tracer concentration with a tracer modulation scheme employed by the modulator to generate an uplink telemetry signal conveying the downhole tool measurement or communication.

15. The downhole telemetry unit of claim 14, wherein the modulator comprises at least one tracer-release component that is controlled by the digital signal.

16. The downhole telemetry unit of claim 15, wherein the at least one tracer-release component comprises a heater element.

17. The downhole telemetry unit of claim 15, wherein the at least one tracer-release component comprises a port element on an exterior surface of the telemetry unit.

18. The downhole telemetry unit of claim 15, wherein the at least one tracer-release component comprises an electrolysis element or catalytic element.

19. The downhole telemetry unit of claim 15, wherein the at least one tracer-release component comprises tracer capsules and at least one actuator to break tracer capsules.

20. The downhole telemetry unit of claim 15, wherein the at least one tracer-release component comprises a pressurized gas container and a valve.

21. The downhole telemetry unit of claim 14, further comprising a power supply that provides power to the modulator.

* * * * *